United States Patent [19]

Betz

[11] Patent Number: 5,053,587

[45] Date of Patent: Oct. 1, 1991

[54] HIGH-VOLTAGE DISTRIBUTOR FOR AN IGNITION SYSTEM OF AN INTERNAL COMBUSTION ENGINE

[75] Inventor: Dieter Betz, Vaihingen, Fed. Rep. of Germany

[73] Assignee: Robert Bosch GmbH, Stuttgart, Fed. Rep. of Germany

[21] Appl. No.: 459,754

[22] PCT Filed: May 20, 1989

[86] PCT No.: PCT/DE89/00316

§ 371 Date: Jan. 10, 1990

§ 102(e) Date: Jan. 10, 1990

[87] PCT Pub. No.: WO90/00227

PCT Pub. Date: Jan. 11, 1990

[30] Foreign Application Priority Data

Jun. 30, 1988 [DE] Fed. Rep. of Germany ..... 3821995

[51] Int. Cl.[5] ..... H01H 19/00; F02P 7/02

[52] U.S. Cl. ..... 200/19 R; 200/19 DC; 200/19 DR

[58] Field of Search ..... 200/19 R, 19 DC, 19 R, 200/30 R

[56] References Cited

U.S. PATENT DOCUMENTS

| | | | |
|---|---|---|---|
| 1,370,077 | 1/1921 | Whisler | 200/19 DR X |
| 1,665,265 | 4/1928 | Hosterman | 200/30 R |
| 1,890,305 | 12/1932 | Schwarzman | 200/19 A X |
| 2,418,504 | 4/1947 | Frei | 200/19 DR X |
| 4,023,546 | 5/1977 | Kawakami | 200/19 DR X |
| 4,562,317 | 12/1985 | Gerber et al. | 200/19 DR |
| 4,575,593 | 3/1986 | Welker et al. | 200/19 DR |
| 4,632,077 | 12/1986 | Novak et al. | 200/19 R X |

FOREIGN PATENT DOCUMENTS

| | | | |
|---|---|---|---|
| 3246903 | 10/1983 | Fed. Rep. of Germany | 200/19 DR |
| 2133120 | 11/1972 | France . | |
| 2506849 | 3/1982 | France . | |
| 529645 | 3/1941 | United Kingdom . | |

*Primary Examiner*—J. R. Scott

*Attorney, Agent, or Firm*—Michael J. Striker

[57] ABSTRACT

A high-voltage distributor for an ignition system of an internal combustion engine has a distributor cap (10) of insulating material and a distributor rotor (14), which rotates in a distributor housing (11). A center electrode (12) and several fixed electrodes (13) are arranged in the distributor cap (10). The distributor rotor (14), which rotates synchronously with the camshaft of the internal combustion engine, in each case establishes an electrical connection between the center electrode (12) and one of the fixed electrodes (13) during its rotation around an axis of rotation (15). To achieve a long wearing contact between the center electrode (12) and the rotor electrode (16), the distributor rotor (14) carries a dome (20), which is coaxial to the distributor rotor and in which a carbon contacting body (24) is held slidably in a tight fit in a centrally located cylindrical guide therein. The carbon contacting body (24) is pressed with its front end, carrying a convex portion (25) with a tip, against the center electrode by a compression spring (23), which is supported on the rotor electrode (16). The distributor rotor has an integral annular wall surrounding the dome spaced a distance therefrom, which protrudes axially beyond a free end of the dome.

5 Claims, 2 Drawing Sheets

HIGH-VOLTAGE DISTRIBUTOR FOR AN IGNITION SYSTEM OF AN INTERNAL COMBUSTION ENGINE

BACKGROUND OF THE INVENTION

The invention relates to a high-voltage distributor for an ignition system of an internal combustion engine.

A high-voltage distributor for an ignition system is known comprising a distributor cap of insulating material, which has a center electrode and several fixed electrodes and a distributor rotor which rotates synchronously with the camshaft of the internal combustion engine establishing in each case an electrical connection between the center electrode and one of the fixed electrodes via a rotor electrode.

In the known high-voltage distributors of this type, the center electrode for establishing the electrical contact with the distributor rotor is provided with a carbon electrode or carbon contacting body. The contacting body or carbon electrode is axially displaceably held in a guide sleeve in the distributor cap and rests with a convex portion on its front face on the rotor electrode in the distributor rotor under the action of a compression spring. The compression spring is supported at the bottom of the guide sleeve on a contact plate, which is electrically connected to a distributor connection and, at the same time, is used for supplying high voltage to the carbon electrode or contacting body.

This type of construction of the center electrode requires very low tolerances in the linear alignment of the axis of rotation of the distributor rotor and the longitudinal axis of the carbon contacting body, which passes through the highest point of the convex portion of the contacting body. The point of contact between the carbon contacting body and the rotating rotor electrode, which is desirable for reasons of low wear, is worn away in operation with even slight eccentricity between the axis of rotation and the longitudinal axis and the carbon contacting body travels over the rotor electrode along a circular track as a result of which a much higher wear is produced in the carbon electrode or carbon contacting body.

SUMMARY OF THE INVENTION

It is an object of the present invention to provide a high-voltage distributor for an ignition system of an internal combustion engine of the above-described type, in which a low-wear point contact between the center electrode and the rotor electrode is maintained in operation even with an eccentricity between the axis of rotation of the distributor rotor and the longitudinal axis of the pin-shaped sliding contacting body (for example, a carbon electrode).

According to the present invention the distributor rotor has a dome, which is integral therewith, coaxial with the distributor rotor and protrudes towards the distributor cap. The dome has a centrally located cylindrical guide connected with the rotor electrode. In the cylindrical guide there is an axially displaceable pin-shaped sliding contacting body which contacts with its front face against the center electrode under the action of a compression spring which is supported directly or indirectly on the rotor electrode.

By comparison, the high-voltage distributor according to the invention, has the advantage that the low-wear point contact between center electrode and rotor electrode is maintained even with an eccentricity between the axis of rotation of the distributor rotor and the longitudinal axis of the pin-shaped sliding contacting body, for example a carbon electrode. The prerequisite for this is a wobble-free rotation of the distributor rotor, which is generally always a feature of the above type of distributors.

According to another feature of the invention the distributor rotor has an annular wall surrounding the dome and spaced a distance therefrom. This annular wall protrudes beyond the free end of the dome and is integral with the distributor rotor.

The pin-shaped sliding contacting body can slide with a close fit in the guide and has convex portion with a tip on its front face to provide contact with the center electrode. The tip of the convex portion is preferably located approximately on the axis of rotation of the distributor rotor.

The compression spring may be supported indirectly or directly on the rotor electrode. Advantageously, an electrically conductive cap is located between the compression spring and the rotor electrode in the guide, the cap contacting the rotor electrode electrically.

Advantageously, a contact plate is provided for the carbon electrode or contacting body attached to the center electrode, which protrudes from the distributor cap toward the distributor rotor. The contact plate is advantageously made of brass.

The annular wall axially projects past the guide dome providing a certain protection of this sliding contacting body during assembly of the high-voltage distributor. Since, for installation reasons, the distributor cap is inserted laterally, that is, radially with respect to the distributor housing axis, and is then mounted in a centered position on the distributor housing containing the distributor rotor, the pin-shaped sliding contact, which protrudes far from the guide dome under the action of the compression spring in the unloaded condition, is exposed to the risk of fracture due to the impact of cap parts, which produce lateral bending stresses in it. The annular wall here absorbs the significant impact energy, so that the distributor cap is moved farther with greater caution thereafter. At the same time, the annular wall extends the leakage path between the high-voltage-conducting parts of the high-voltage distributor in the operating condition.

BRIEF DESCRIPTION OF THE DRAWING

The invention is explained in greater detail in the description following, with reference to an illustrative embodiment shown in the drawing, in which.

DETAILED DESCRIPTION OF THE INVENTION

Figure 1:
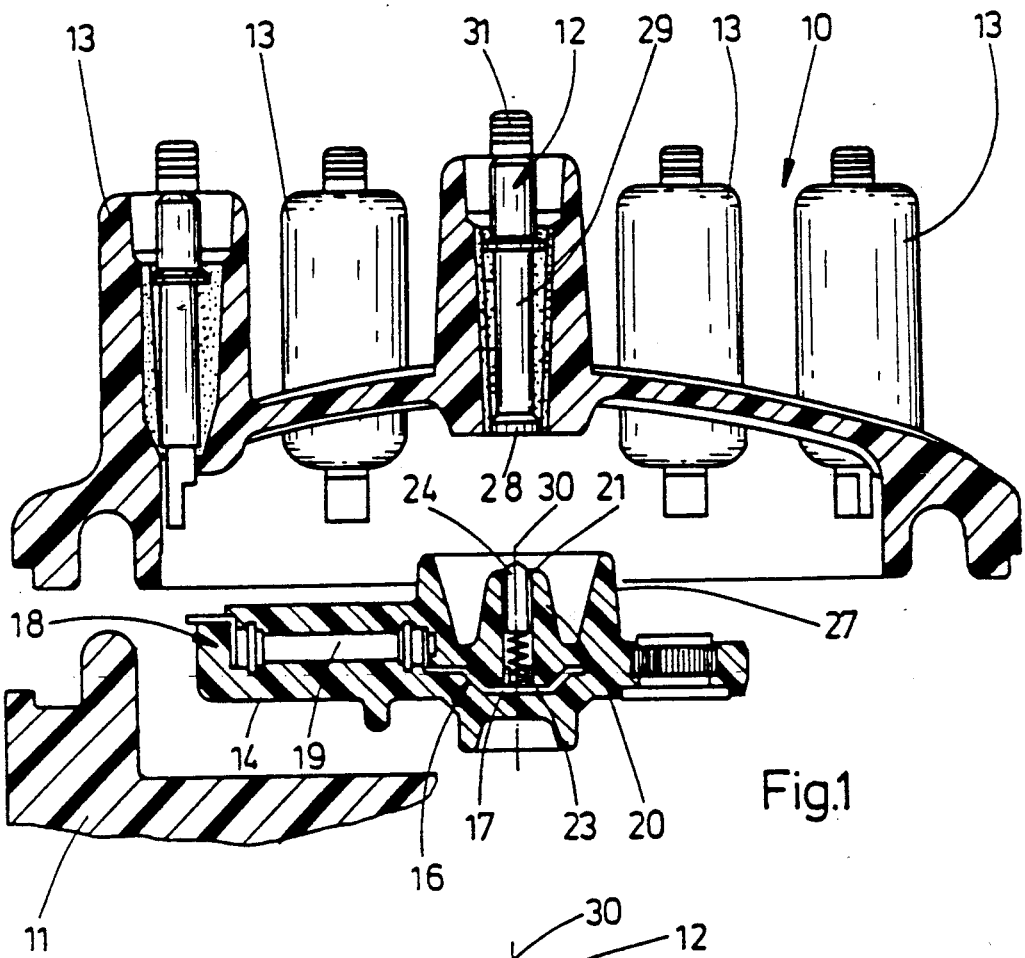
FIG. 1 is a partially cutaway longitudinal cross sectional view of a high-voltage distributor in a not yet completely assembled state.

The high-voltage distributor for a multi-cylinder internal combustion engine, has a distributor cap 10 of insulating material, which is detachably placed on a distributor housing 11. The distributor cap 10 carries a centrally arranged center electrode 12 and a number of fixed electrodes 13, which corresponds to the number of cylinders of the internal combustion engine. The fixed electrodes are arranged at equal distance from one another on a circular path, which is concentric with respect to the center electrode 12.

The distributor housing 11 contains a distributor rotor 14, which is supported to be rotatable around an axis of rotation 15 and is nonrotatably rigidly connected to the camshaft of the internal combustion engine so that it rotates synchronously with the latter. In this arrangement, the axis of rotation 15 of the distributor rotor 14 is essentially aligned with the longitudinal axis 30 of the center electrode 12. The distributor rotor 14, which also consists of insulating material, carries a rotor electrode 16, which consists of a center part 17, which is arranged in the area of the axis of rotation 15 and transversely thereto, and a distributor finger 18. The center part 17 and the distributor finger 18 are electrically connected to one another via an interference suppression resistor 19. In the completely assembled state (FIG. 2), the center part 17 is electrically connected to the center electrode 12, while the distributor finger 18 successively comes into contact with one of the fixed electrodes 13 during the rotation of the distributor rotor 14. In this manner, an electrical connection is made successively for each fixed electrode between the center electrode 12 and one of the fixed electrodes 13.

Figure 2:
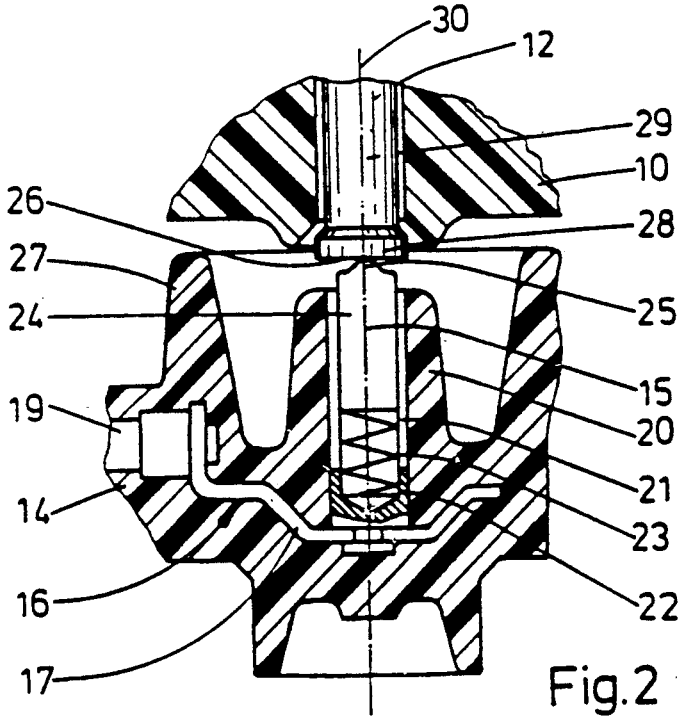
FIG. 2 is a detailed cutaway cross sectional view of a distributor according to our invention showing the distributor cap and distributor rotor in a completely assembled state.

As is shown enlarged in FIG. 2, the distributor rotor 14 carries in the vicinity of the center part 17 of the rotor electrode 16, a dome 20, which is concentric to the axis of rotation 15 of the distributor rotor 14 and which is integral with the distributor rotor 14 consisting of insulating material. In the dome 20, a guide cylinder 21 is provided, the cylinder axis of which is also coincident with the axis of rotation 15 of the distributor rotor 14. The cylindrical guide 21 extends to the center part 17 of the rotor electrode 16. At the bottom of the cylindrical guide 21 there is a cap 22 of electrically conductive material, which is permanently connected to the center part 17. In the interior of the cap 22, a compression spring 23 is supported, which rests with its other end against a pin-shaped sliding contacting body 24, for example a carbon electrode, which is axially displaceable in the cylindrical guide 21, and presses this carbon electrode against the front end of the center electrode 12 protruding from the distributor cap 10 in the completely assembled state of the high-voltage distributor (FIG. 2). In this arrangement, the carbon contacting body 24 is provided on its front face protruding from the dome 20 with a convex portion 25, the tip or highest point of which is located on the axis of rotation 15 of the distributor rotor 14. This establishes a point contact between the carbon contacting body 24 and the contact area 26 of the center electrode 12 during operation of the high-voltage distributor, which is advantageous for achieving a low wear at the carbon contacting body 24. This point contact between the carbon contacting body 24 and contact area 26 is also maintained, if there is eccentricity between the axis of rotation 15 of the distributor rotor 14 and the longitudinal axis of the center electrode 12, since the carbon contacting body 24 is carried in a close fit in the cylindrical guide 21 in the dome 20 and the center of the nonrotatably symmetric convex portion 25 is located on the axis of rotation 15. The contact area 26 is formed on the free front face of a contact plate 28 of brass, which protrudes slightly from the distributor cap 10. The contact plate 28 is preferably integral with a contact pin 29, which leads to a distributor connection 31 for the center electrode 12.

The dome 20 is surrounded by a nonrotatable symmetric annular wall 27, which is arranged spaced from the dome 20 and protrudes beyond the free end of the dome 20. The wall 27 is integral with the distributor rotor 14. This wall 27 has two tasks. On the one hand, it extends the electric leakage path from the carbon contacting body 24 to other current-conducting parts in the operating condition of the high-voltage distributor. On the other hand, it protects the carbon contacting body 24, which protrudes far from the dome 20 under the action of the compression spring 23 in the unloaded state, against fracture during assembly of the distributor cap 10. Such a fracture hazard to the carbon contacting body 24 is derived from the fact that, for installation reasons, during assembly of the high-voltage distributor, the distributor cap 10 must be pushed laterally, that is transversely with respect to the axis of rotation 15 of the distributor rotor 14, onto the distributor housing 11, so that it can then be placed onto the distributor housing 11 in the centered position (FIG. 1), during which operation the center electrode 12 comes into contact with the carbon contacting body 24 and pushes the latter into the guide cylinder 21 in the dome 20 against the compression spring 23. When the distributor cap 10 is introduced laterally, there is a risk that cap parts impact against the protruding carbon contacting body 24 and break off the latter. During the assembly, the annular wall 27 absorbs such impacts of cap parts, which would otherwise reach the carbon contacting body 24, after which the distributor cap 10 is then moved forwards much more cautiously.

Figure 3:
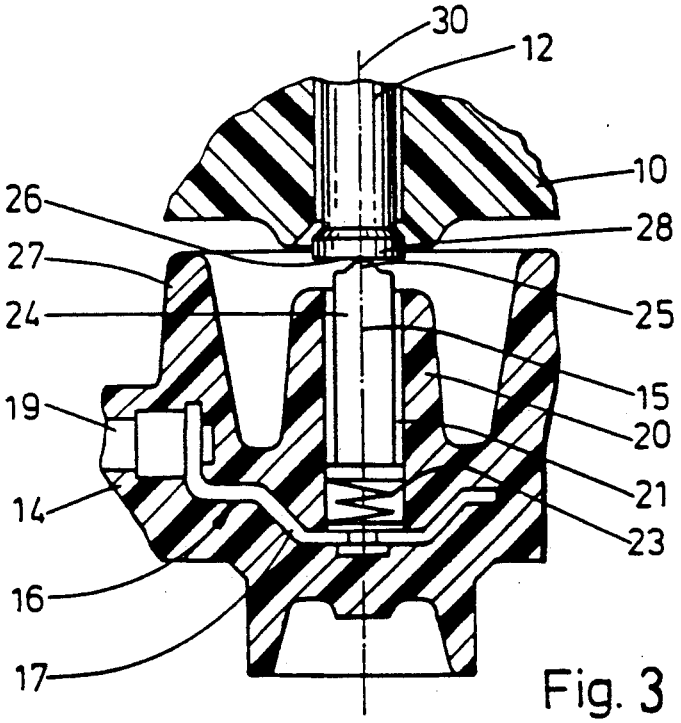
FIG. 3 is an enlarged cutaway cross sectional view of a portion of the embodiment of a distributor according to our invention similar to FIG. 1.

Alternatively, FIG. 3 shows clearly that in the embodiment of FIG. 1 the compression spring 23 is supported directly on the center part 17 of the rotor electrode 14.

It will be understood that each of the elements described above, or two or more together, may also find a useful application in other types of structures differing from the types described above.

While the invention has been illustrated and described as embodied in a high-voltage distributor for an ignition system of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. A high voltage distributor for an ignition system of an internal combustion engine having and driving a camshaft, comprising:

a distributor cap made of insulating material which has a center electrode and a plurality of fixed electrodes, and a distributor rotor having a rotor electrode, said distributor rotor being connected to said camshaft so as to rotate synchronously with said camshaft and establish between each of said fixed electrodes on-after-the-other and said center electrode an electrical connection via said rotor electrode, said distributor rotor having an axis of rotation and a dome, which is an integral part of said rotor, which has a free end, which is coaxial with said distributor rotor and which protrudes towards the distributor cap, said dome having a centrally located cylindrical guide which extends to the rotor electrode containing an axially displaceable pin-shaped sliding contacting body in a close fit and a compression spring located between said sliding contacting body and said rotor electrode, said sliding contacting body having a convex portion with a tip on a front face thereof which contacts against the center electrode under action of the compression spring, and said distributor rotor also having an annular wall surrounding said dome, spaced from the dome, integral with said dome and protruding beyond the free end of the dome, the tip of said convex portion being located approximately on said axis of rotation of said distributor rotor.

2. A high-voltage distributor according to claim 1, further comprising a cap of electrically conductive material located between said compression spring and said rotor electrode in said guide, said cap contacting said rotor electrode electrically and supporting said compression spring.

3. A high-voltage distributor according to claim 1, further comprising a contact plate connected to said center electrode which protrudes from said distributor cap toward said distributor rotor and on which said convex portion of said contacting body engages with said tip.

4. A high-voltage distributor according to claim 3, wherein said contact plate is made of brass.

5. A high-voltage distributor according to claim 1, wherein said compression spring is supported directly on said rotor electrode.

* * * * *